US007156616B2

(12) United States Patent
Lee

(10) Patent No.: US 7,156,616 B2
(45) Date of Patent: Jan. 2, 2007

(54) COMBINATIVE STANDING FAN

(76) Inventor: Ming-Tsung Lee, P.O. Box 90, Tainan City 70499 (TW)

( * ) Notice: Subject to any disclaimer, the term of this patent is extended or adjusted under 35 U.S.C. 154(b) by 151 days.

(21) Appl. No.: 10/954,166

(22) Filed: Oct. 1, 2004

(65) Prior Publication Data

US 2006/0073009 A1 Apr. 6, 2006

(51) Int. Cl.
*F04D 29/46* (2006.01)

(52) U.S. Cl. ..... 415/127; 415/211.2; 415/214.1; 415/213.1; 416/100

(58) Field of Classification Search ..... 415/126, 415/127, 203, 214.1, 211.2; 416/100
See application file for complete search history.

(56) References Cited

U.S. PATENT DOCUMENTS 5,266,004 A * 11/1993 Tsumurai et al. ..... 416/100
6,321,034 B1 * 11/2001 Jones-Lawlor et al. ..... 392/367
6,830,433 B1 * 12/2004 Birdsell et al. ..... 416/110
2005/0123392 A1 * 6/2005 Belsito et al. ..... 415/53.1
2005/0123402 A1 * 6/2005 Lim ..... 416/100

* cited by examiner

*Primary Examiner*—Ninh H. Nguyen

(57) ABSTRACT

A combinative standing fan includes a vertical shaft fan, a first, and a second tubular cover. The first and the second tubular cover respectively consist of a front half cover and a rear half cove. The front half covers of the two tubular covers are provided with plural wind inlets, and the rear half covers of them are provided with plural wind outlets. The first tubular cover has a guide groove in an upper end, and the second tubular cover has a bottom edge at the bottom to fit with the guide groove so the second tubular cover may rotate relative to the first one, with the guide groove and the bottom edge. When the shaft fan operates, air comes in the wind inlets of the two tubular covers and blows out of the wind outlets of them. The second tubular cover is rotatable to the first one, letting the fan blow winds in many different angles or directions simultaneously.

2 Claims, 6 Drawing Sheets

COMBINATIVE STANDING FAN

BACKGROUND OF THE INVENTION

1. Field of the Invention

This invention relates to a combinative standing fan, particularly to one having a shaft fan, a first tubular cover surrounding a lower portion, and a second tubular cover surrounding an upper portion of the shaft fan. The first and the second tubular cover respectively consist of a front half cover and a rear half cover, and the front half covers of the two tubular covers have a plurality of wind inlets, and he rear half covers have a plurality of wind outlets. The first tubular cover is provided with an annular guide groove at the upper end and the second tubular cover is provided with an annular edge at the bottom to fit with the annular guide groove to combine the first and the second tubular cover together. Further, an upper cap is provided to close up on top of the second tubular cover. When the shaft fan operates to rotate, air is sucked into the first and the second tubular cover through the wind inlets and blown out of the wind outlets. A user can rotates the second tubular cover relative to the first tubular cover so as to change the angles or directions of the wind outlets, so the standing fan can blow winds to different angles or directions at the same time.

2. Description of the Prior Art

Common traditional fans can blow winds to a large scope with a rotary base or a rotary faceplate, but impossible to blow winds to the two opposite sides and the rear side at the same time, Further, traditional standing or table fans can be adjusted in its vertical angles by adjusting the whole head, then if it is adjusted to blow to an upper angle, the lower direction cannot be blown, or vice versa.

SUMMARY OF THE INVENTION

This invention has been devised to offer a combinative standing fan able to be altered in the wind blowing angles or directions and able to blow to different angles or directions at the same time.

The feature of the invention is a first tubular cover provided on a base for surrounding a lower half portion of a shaft fan, and a second tubular cover for surrounding an upper half portion of the shaft fan. The first tubular cover consists of a front half cover and a rear half cover and the front and the second half cover both have an annular stop edge and an annular guide groove under the stop edge. The second tubular cover is rotatably provided on the first tubular cover, consisting of a front and a rear half cover and having an annular edge in the bottom to engage with the guide groove and secured by the stop edge of the first tubular cover. The front half covers of the two tubular covers are provided with a plurality of wind outlets and the rear half covers of them are provided with a plurality of wind inlets. Further, an upper cap is provided to close airtight on the top of the second tubular cover.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
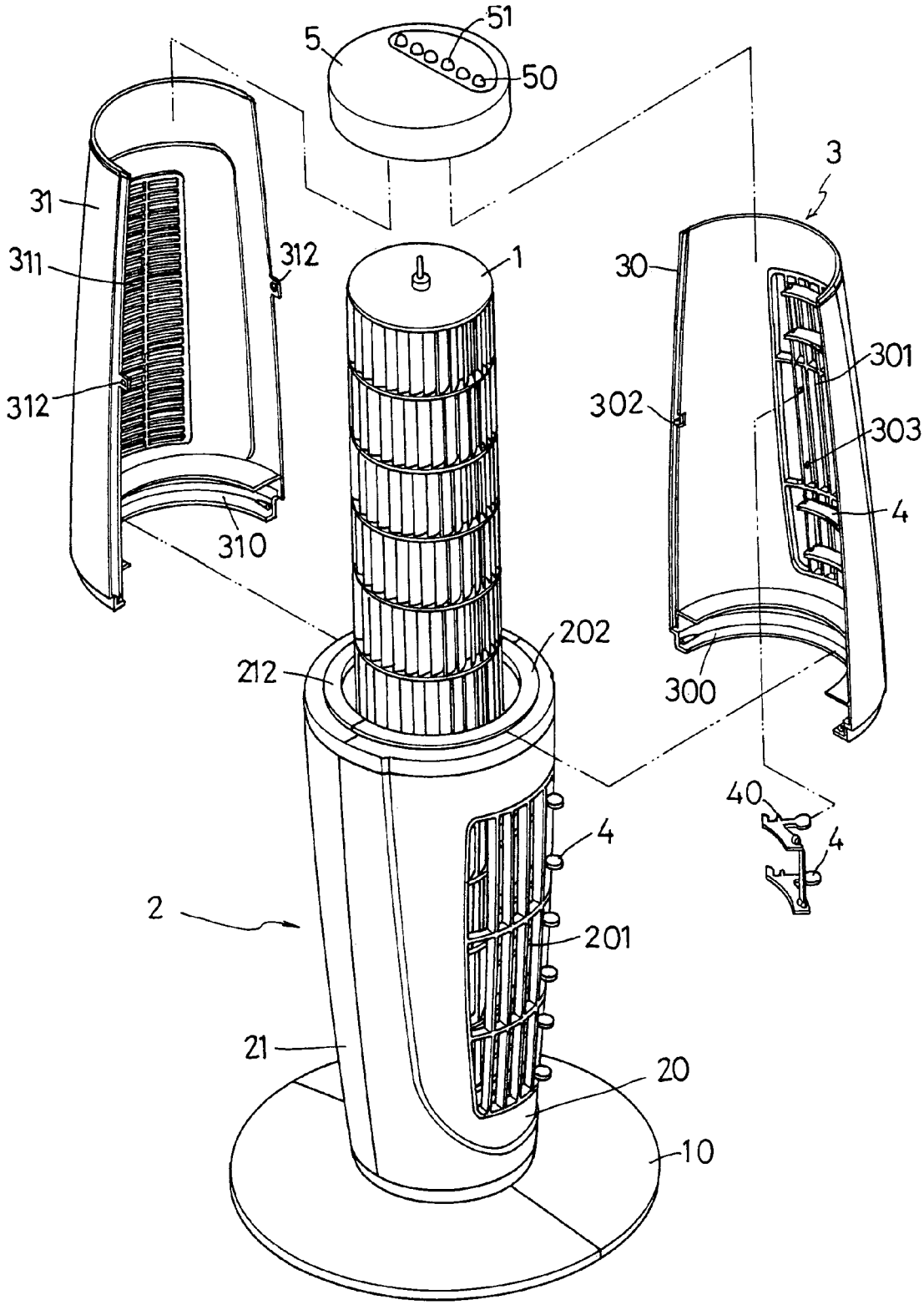
FIG. 1 is an exploded perspective view of a first embodiment of a combinative standing fan in the present invention.
Figure 2:
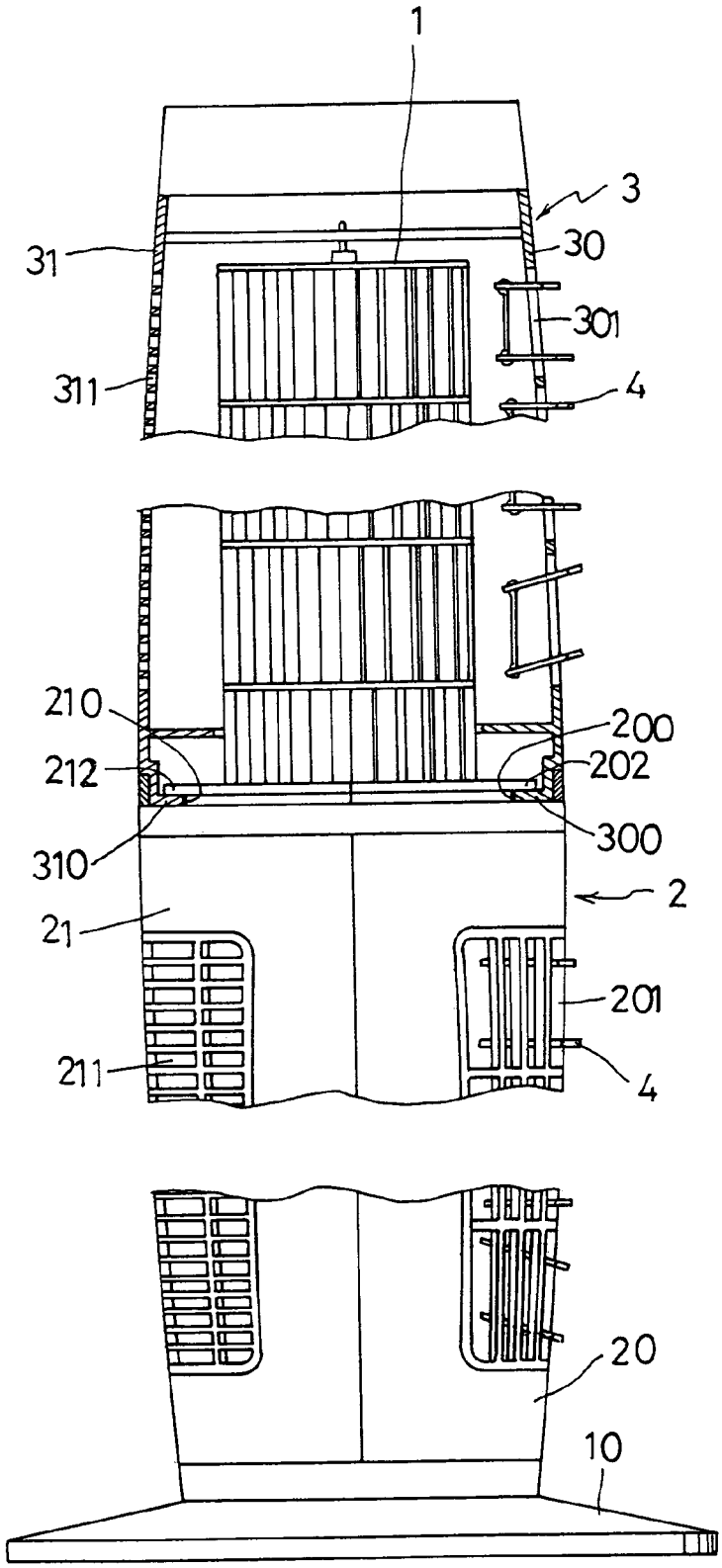
FIG. 2 is a partial cross-sectional view of the first embodiment of the combinative standing fan in the present invention.
Figure 3:
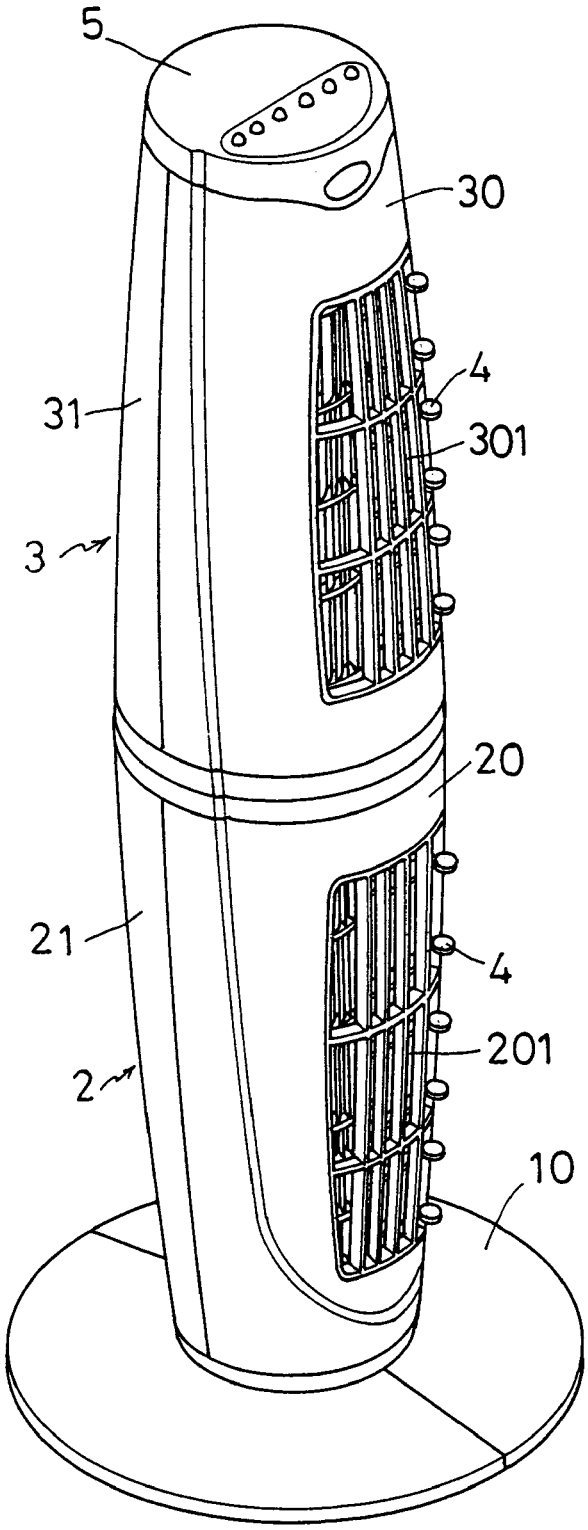
FIG. 3 is a perspective view of the first embodiment of the combinative standing fan in the present invention.
Figure 4:
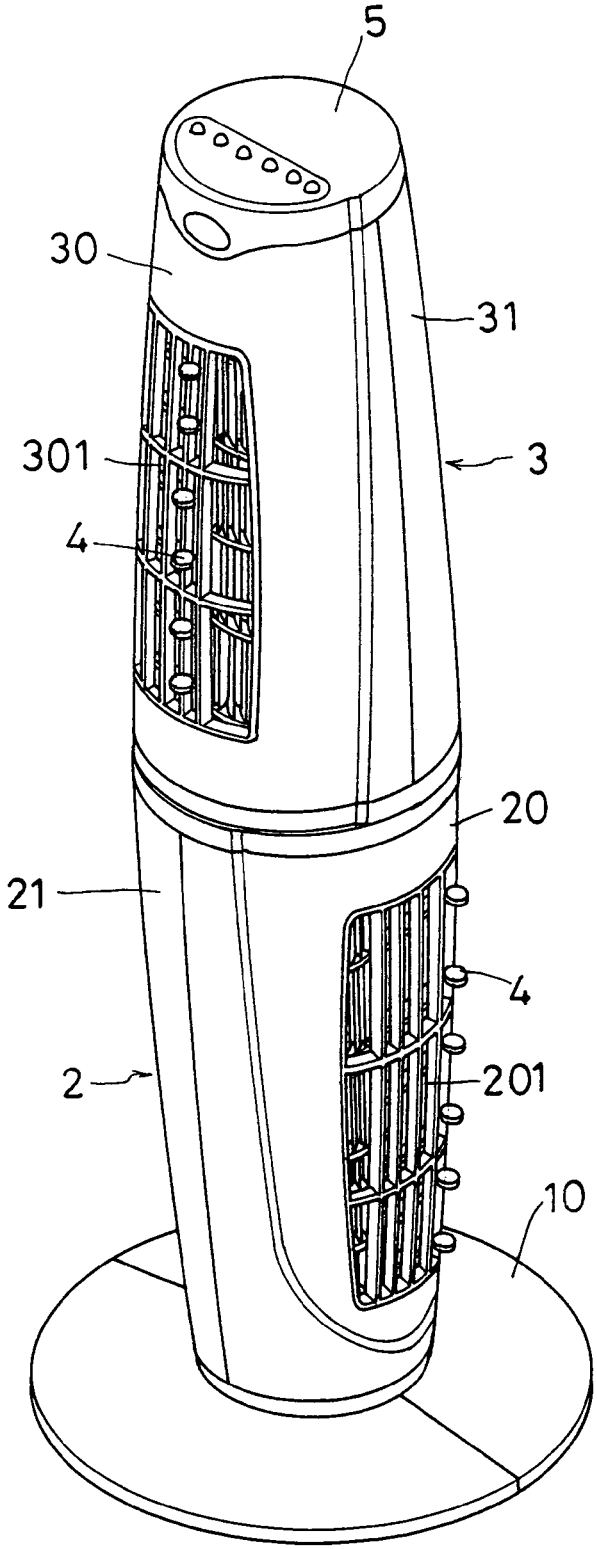
FIG. 4 is a perspective view of the first embodiment of the combinative standing fan used in a first way in the present invention.
Figure 5:
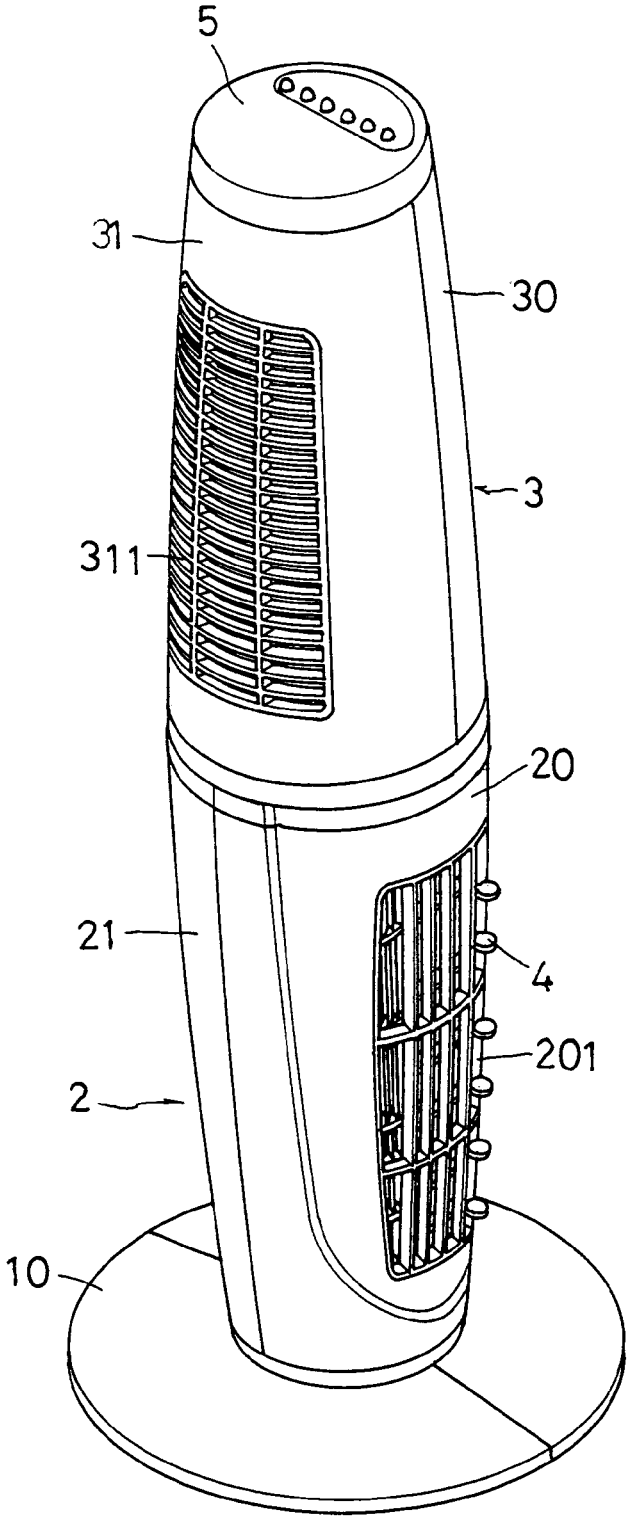
FIG. 5 is a perspective view of the first embodiment of the combinative standing fan used in a second way in the present invention; and, FIG. 6 is a perspective view of a second embodiment of a combinative standing fan in the present invention.

A first embodiment of a combinative standing fan in the present invention, as shown in FIGS. 1, 2 and 3, includes an upright shaft fan 1, a base 2 provided under the bottom of the upright shaft fan 1, a first tubular cover 2, and a second tubular cover 3, and an upper cap 5 as main components.

The first tubular cover 2 is combined on the base 10 and surrounds a lower half portion of the shaft fan 1, consisting of a front and a rear half cover 20 and 21 combined with each other by means of fitting projections and fitting holes. The front and the rear half cover 20 and 21 are provided with a semi-annular guide groove 200 and 210, and a stop edge 202 and 212 in an upper side. Further, the front half cover 20 has a plurality of wind outlets 201, and several adjust members 4 pivotally connected in the wind outlets 201, and the rear half cover 21 has a plurality of wind inlets 211.

The second tubular cover 3 is combined on the first tubular cover 2, consisting of a front half cover 30 and a rear half cover 31 combined with each other. The front and the rear half cover 30 and 31 are respectively provided with bottom semi-circular edges 300 and 310 to engage with the guide grooves 200 and 210 of the first tubular cover 2. Further, the front half cover 30 has a plurality of wind outlets 301, and the rear half cover 31 has a plurality of wind inlets 311; the front half cover 3 has a fit stud 302 respectively at two vertical side edges, and the rear half cover 3 has a fit hole 312 respectively in two vertical side edges to fit with the fit studs 302. Further, plural adjust members 4 are provided to connect pivotally with recesses 303 formed in sidewalls defining the wind outlets 301 of the front half cover 30 and having a projection 40 at one end to fit in the recesses 303.

The upper cap 5 is closed airtight on the top of he second tubular cover 3, having a switch button 51 and several wind-speed adjusting buttons 51 for turning on and off the shaft fan 1 and the wind speed of the shaft fan 1.

In assembling, as shown in FIGS. 1, 2 and 3, firstly, the front half cover 30 of the second tubular cover 3 is made to have its bottom edge 300 fit in the guide groove 200 (or 210) of the first tubular cover 2, and then the rear half cover 31 is made to have its bottom edge 310 fit in the guide groove 200 (or 210) of the first tubular cover 2, with the bottom edges 310 and 311 able to slide along the guide grooves 200 (or 210) resting on the stop edges 202 (or 212) in case the second tubular cover 3 is rotated manually. Then the fit studs 302 of the front half cover 30 are forced to fit with the fit holes 312 of the rear tubular cover 31, and finally the upper cap 5 is closed tightly on the top of the second tubular cover 3, finishing the assembly.

In using, as shown in FIGS. 2, 3, 4 and 5, pushing the switch button 50 will start the operation of the shaft fan 1, with air sucked in the interior space of the first and the second tubular cover 2 and 3 through the wind inlets 211 and 311 of the first and the second tubular cover 2 and 3, and blown by the rotation of the shaft fan 1 to shoot out of the wind outlets 201 and 301 of the two tubular covers 2 and 3. Further, a use can adjust the vertical angle of the adjust members 4, and also can rotate the second tubular cover 3 relative to the first cover 2 to alter the direction of the wind outlets 301 of the second cover 3 to different angles, for example, 45, 90 or 180 degrees, so the fan can blow winds to different angles or directions at the same time.

Figure 6:
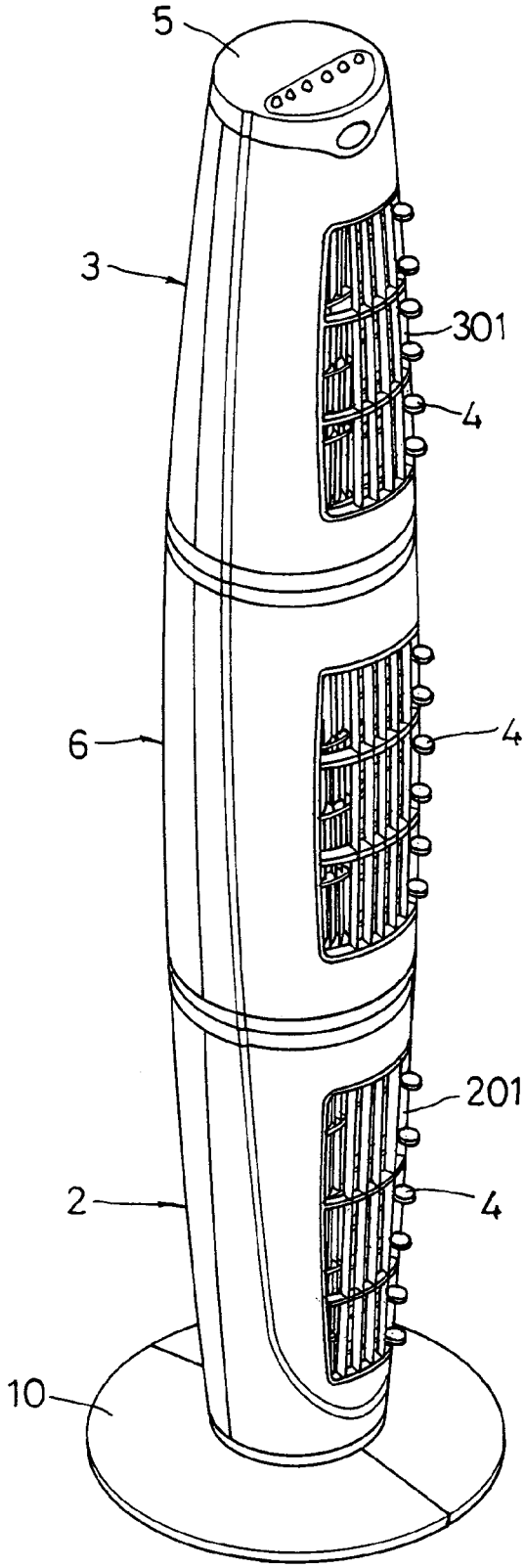

Next, a second embodiment of a combinative standing fan in the invention is shown in FIG. 6, including a third tubular cover 6 additionally provided to the first embodiment between the first and the second tubular cover 2 and 3. The third tubular cover 6 has at the bottom a bottom edge the same as that of the second tubular cover 3 to fit with the guide grooves 200 and 210 of the first tubular cover 2, and guide grooves at the upper end the same as those of the first tubular cover 3 to fit with the bottom edges of the second tubular cover 3. Then the second and the third tubular cover 3 and 6 can be altered in their angle to each other to form many different angles for winds to blow out, for example 45, 60, 90 or 180 degrees.

While the preferred embodiments of the invention have been described above, it will be recognized and understood that various modifications, may be made therein and the appended claims are intended to cover all such modifications that may fall within the spirit and scope of the invention.

What is claimed is:

1. A combinative standing fan comprising:

a vertical shaft fan fixed on a base;

a first tubular cover combined on said base and consisting of a front half cover and a rear half cover combined with each other, said front and said rear half cover respectively having a stop edge on an upper end and a guide groove formed under an inner wall of the stop edge, said front half cover having a plurality of wind inlets, said rear half cover having a plurality of wind outlets;

a second tubular cover combined on said first tubular cover and consisting of a front half cover and rear half cover combined with each other, said front half cover having a bottom edge to fit in said guide grooves of said first tubular cover and resting stably on said stop edge, said front half cover having a plurality of wind outlets and said rear half cover having a plurality of wind inlets; and, an upper cap closing airtight on the top of said second tubular cover;

wherein said front half cover of said first and said second tubular cover are provided with adjust members combined in said wind outlets, for adjusting angles or directions of winds blown out; and wherein a third tubular cover is further provided between said first and said second tubular cover with the same structure of said second tubular cover so that said second and said third tubular cover may be rotated relative to each other and to said first tubular cover, for forming many different directions or angles for winds to blow out, wherein the third tubular cover has a plurality of holes on a periphery thereof as wind inlets and wind outlets;

wherien a cross section of each of the first, second and third tubular covers has an approximate round shape and the areas of the cross sections have a maximum size at a middle section of the standing fan and then reduced from the middle portion to two ends of the standing fan; and wherein the guide grooves of the first tubular cover are arranged at an axial direction of the first tubular cover and the bottom edges of the third tubular cover is approximately parallel to an axis of the third tubular cover.

2. The combinative standing fan as claimed in claim 1, wherein the front half covers of said first and said second tubular cover have plural fit studs on an inner wall of the two vertical sides, and the rear half covers of said first and said second tubular cover have an insert hole to match with said fit studs.

* * * * *